US006253739B1

(12) United States Patent
Golomb et al.

(10) Patent No.: US 6,253,739 B1
(45) Date of Patent: Jul. 3, 2001

(54) DUAL FUNCTION FUEL SUPPLY MODULE

(75) Inventors: Christopher J Golomb; Richard H Bienick, both of Rochester; James A Walendzik, Leonard, all of MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/465,902

(22) Filed: Dec. 17, 1999

(51) Int. Cl.[7] ..... F02M 33/04
(52) U.S. Cl. ..... 123/509; 123/497
(58) Field of Search ..... 123/497, 458, 123/509, 510, 446, 495

(56) References Cited

U.S. PATENT DOCUMENTS

| | | | | |
|---|---|---|---|---|
| 3,669,081 | * | 6/1972 | Monpetit | 123/497 |
| 3,913,547 | * | 10/1975 | Wentworth et al. | 123/497 |
| 4,285,316 | | 8/1981 | Stolz et al. . | |
| 4,359,984 | * | 11/1982 | Nakao | 123/497 |
| 4,388,053 | | 6/1983 | Bartel et al. . | |
| 4,503,885 | | 3/1985 | Hall . | |
| 4,756,291 | * | 7/1988 | Cummins et al. | 123/497 |
| 4,928,656 | * | 5/1990 | Ausiello | 123/497 |
| 4,984,554 | * | 1/1991 | Ariga et al. | 123/516 |
| 5,085,193 | * | 2/1992 | Morikawa | 3/458 |
| 5,477,833 | * | 12/1995 | Leighton | 123/497 |
| 5,483,940 | * | 1/1996 | Namba et al. | 123/497 |
| 5,775,304 | * | 7/1998 | Kono et al. | 123/497 |
| 5,839,413 | * | 1/1991 | Krause et al. | 123/179.17 |
| 5,899,193 | * | 5/1999 | Betz II et al. | 123/516 |
| 6,047,684 | * | 4/2000 | Hiraku et al. | 123/497 |

* cited by examiner

*Primary Examiner*—Thomas N. Moulis
(74) *Attorney, Agent, or Firm*—Mark P. Calcaterra

(57) ABSTRACT

A dual function fuel delivery system is provided including a mechanical gear-driven pump and an electric pump. The electric pump is selectively energized to deliver fuel to the mechanical gear-driven pump. The electric pump is energized when an RPM level in the engine is less than a first threshold value or when a fuel rail pressure in a fuel rail of the system is less than a second threshold value. The electric pump is de-energized when the RPM level is greater than or equal to the first threshold value and the fuel rail pressure is greater than or equal to the second threshold value.

20 Claims, 2 Drawing Sheets

DUAL FUNCTION FUEL SUPPLY MODULE

BACKGROUND OF THE INVENTION

1. Technical Field

The present invention generally relates to fuel delivery systems and, more particularly, to a dual function fuel supply module.

2. Technical Field

Internal combustion engines require fuel in the form of gasoline or diesel for operation. A fuel delivery system is required to deliver the fuel from a storage location such as a fuel tank to the internal combustion engine. According to the prior art, three primary fuel delivery systems are provided.

According to a first fuel delivery system, a mechanical gear pump is coupled to the internal combustion engine which drives the pump and draws fuel from the tank to the engine. According to a second system, an electric pump is disposed along a fuel line between the fuel tank and the engine. Upon receipt of an applied current, the electric pump operates to deliver fuel from the fuel tank and deliver it to the engine. According to a third system, an electric pump is disposed within the fuel tank. Upon receipt of an applied current, the fuel pump operates to deliver fuel from the fuel tank to the engine.

Direct injection fuel systems use a mechanical gear-driven pump as part of the high pressure system. Unfortunately, the mechanical pump is not able to prime itself after running dry or after initial installation. Dry operating conditions include first start conditions at the assembly plant, an operator running out of fuel, and breaking into the system for service.

Thus, it would be desirable to provide a fuel delivery system which utilizes a mechanical gear-driven pump in combination with electric pump for fulfilling priming needs.

SUMMARY OF THE INVENTION

The above and other objects are provided by a dual function fuel delivery system. The system includes a mechanical gear-driven pump coupled between an engine and a fuel tank. The mechanical gear-driven pump is coupled to the fuel tank by a first fuel line and a second fuel line. An electric pump is coupled to the second fuel line for selectively providing fuel from the fuel tank to the mechanical gear-driven pump. For example, the electric pump can be energized to deliver fuel to the mechanical gear-driven pump during a potential run dry condition. After the potential run dry condition is passed, the electric pump can be de-energized since the mechanical pump can fulfill its fueling needs by direct vacuum pick-up from the fuel tank. Check valves disposed along the first and second fuel lines ensure that the mechanical gear-driven pump preferentially draws fuel from the fuel tank through the first fuel line thereby bypassing the electric pump. To selectively energize the electric pump, a relay is coupled between a power source and the electric pump. A controller is coupled to the relay for selectively switching the relay between on and off states. This periodically provides power from the power source to the electric pump. For example, power is provided to the electric pump when an RPM level in the engine is less than a first threshold value or when a fuel rail pressure in a fuel rail of the system is less than a second threshold value. These conditions correspond to a situation in which the mechanical pump may not be able to draw fuel directly from the fuel tank. Preferably, the electric pump continues to operate until the RPM level is greater than or equal to the first threshold value and the fuel rail pressure is greater than or equal to the second threshold value. At this point, the mechanical pump is able to satisfy its fueling requirements by drawing fuel from the fuel tank.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of the accompanying drawings in which.

DETAILED DESCRIPTION OF THE PREFERRED EMBODIMENTS

The present invention is directed towards a dual function fuel delivery system for an automotive vehicle. The fuel delivery system has two operating modes including a first mode wherein part time positive fuel pressure is provided utilizing an electric pump and a second mode wherein direct vacuum fuel pick-up utilizing a mechanical pump is provided. When either engine RPM or fuel rail pressure are less than a preselected threshold value, power is supplied to the electric pump to provide positive fuel pressure to the mechanical gear-driven pump. Once both RPM and fuel rail pressure meet or exceed the preselected threshold value, power is shut off from the electric pump. With the electric pump deenergized, the mechanical gear-driven pump's generated vacuum picks up fuel directly from the fuel tank thereby bypassing the electric fuel pump.

Figure 1:
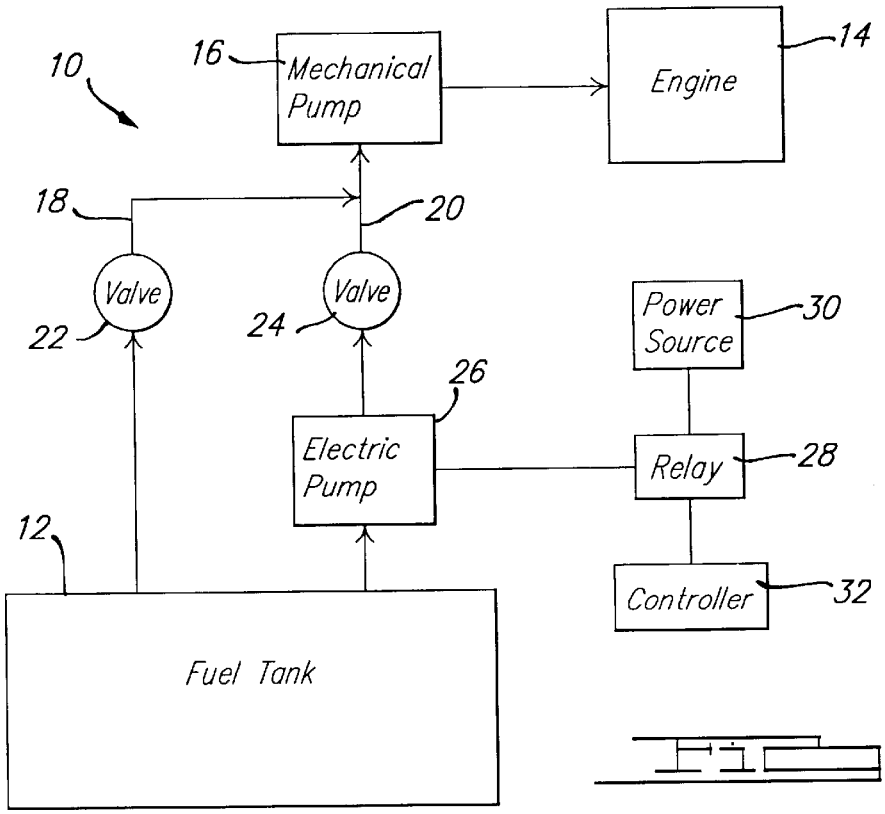
FIG. 1 is a schematic illustration of a dual function fuel delivery system incorporating the teachings of the present invention.

Turning now to the drawing figures, FIG. 1 schematically illustrates a dual function fuel delivery system generally at 10. The system 10 includes a fuel tank 12 associated with an engine 14. A first or mechanical pump 16 is coupled to the engine 14. Preferably, the mechanical pump 16 is a mechanical gear-driven pump which is coupled to the engine 14 in such a way that the engine 14 drives the mechanical pump 16.

A first fuel line 18 is interposed between the mechanical pump 16 and the fuel tank 12. A second fuel line 20 is also interposed between the mechanical pump 16 and the fuel tank 12. A first check valve 22 is disposed along the first fuel line 18 between the mechanical pump 16 and the fuel tank 12. The first check valve 22 normally isolates the fuel tank 12 from the mechanical pump 16. However, when the vacuum generated by the mechanical pump 16 is great enough, the first check valve 22 opens thereby allowing fuel to flow from the fuel tank 12 to the mechanical pump 16.

A second check valve 24 is disposed along the second fuel line 20 between the mechanical pump 16 and a second or electric pump 26 and the fuel tank 12. The second check valve 24 normally isolates the electric pump 26 from the mechanical pump 16. However, when the pressure from the electric pump 26 is great enough, the second check valve 24 opens thereby allowing fuel from the fuel tank 12 to be delivered to the mechanical pump 16. To ensure proper routing of the fuel, it is preferred that the first check valve 22 have an opening pressure which is less than the opening pressure of the second check valve 24. In this way, the vacuum from the mechanical pump 16 preferentially opens the first check valve 22 to ensure fuel flow from the fuel tank 12 through the first fuel line 18.

Figure 1A:
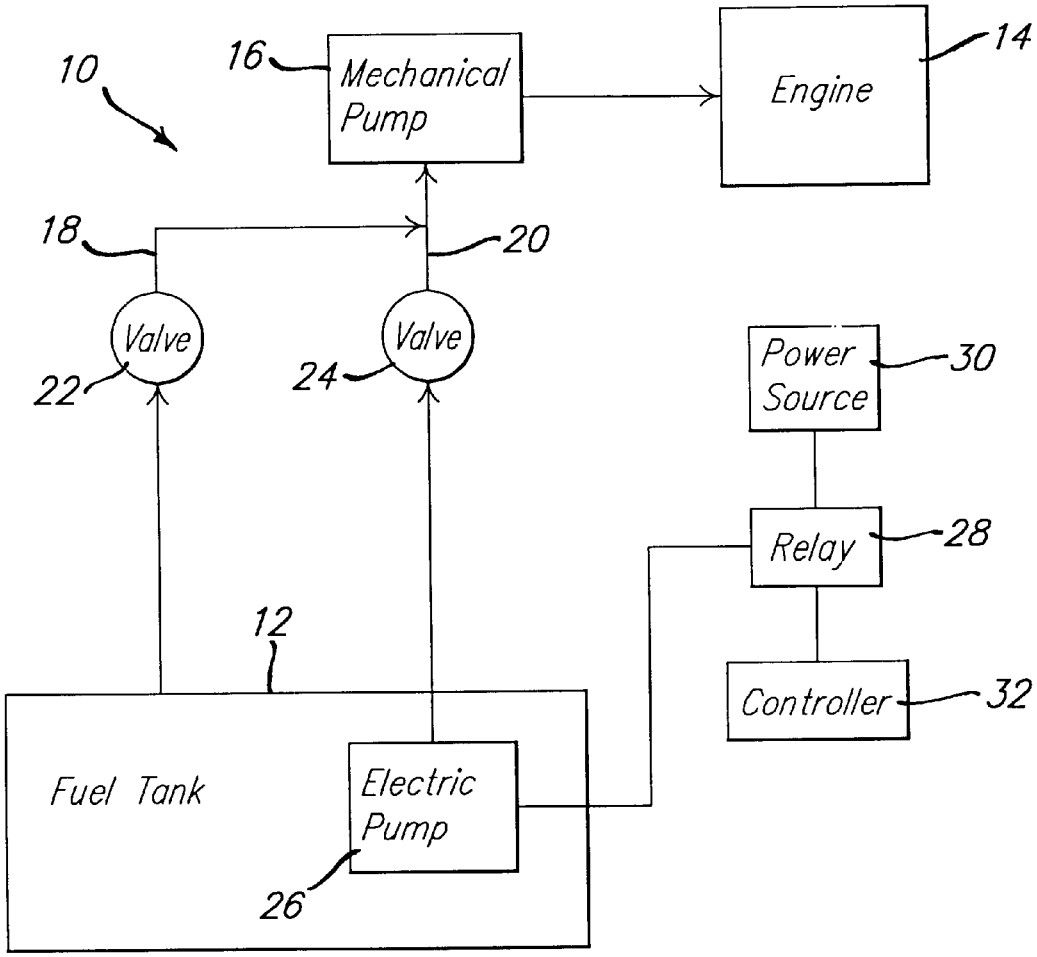
FIG. 1*a* is a schematic illustration of a dual function fuel delivery system according to an alternate embodiment of the present invention.

The electric pump 26 is coupled to the second fuel line 20. As illustrated, the electric pump 26 may be disposed along the second fuel line 20 between the mechanical pump 16 and the fuel tank 12. However, as illustrated in FIG. 1*a* , if desired, the electric pump 26 may be disposed within the fuel tank 12.

The electric pump 26 is preferably configured for selective operation. To provide such operation, the electric pump 26 is electrically coupled to a switch or relay 28. The relay 28 is coupled to a power source 30 and a controller 32. The controller 32 selectively switches the relay 28 between on and off states to periodically provide power from the power source 30 to the electric pump 26. As such, the electric pump 26 is selectively energized and de-energized.

When energized, the electric pump 26 provides fuel from the fuel tank 12 to the mechanical pump 16 through the second check valve 24 on the second fuel line 20. When de-energized, the vacuum from the mechanical pump 16 draws fuel from the fuel tank 12 through the first check valve 22 on the first fuel line 18. Preferably, the electric pump 26 is only operated when the mechanical pump 16 may not be able to prime itself. Otherwise, the mechanical pump 16 uses direct vacuum to pick-up fuel from the fuel tank 12.

Figure 2:
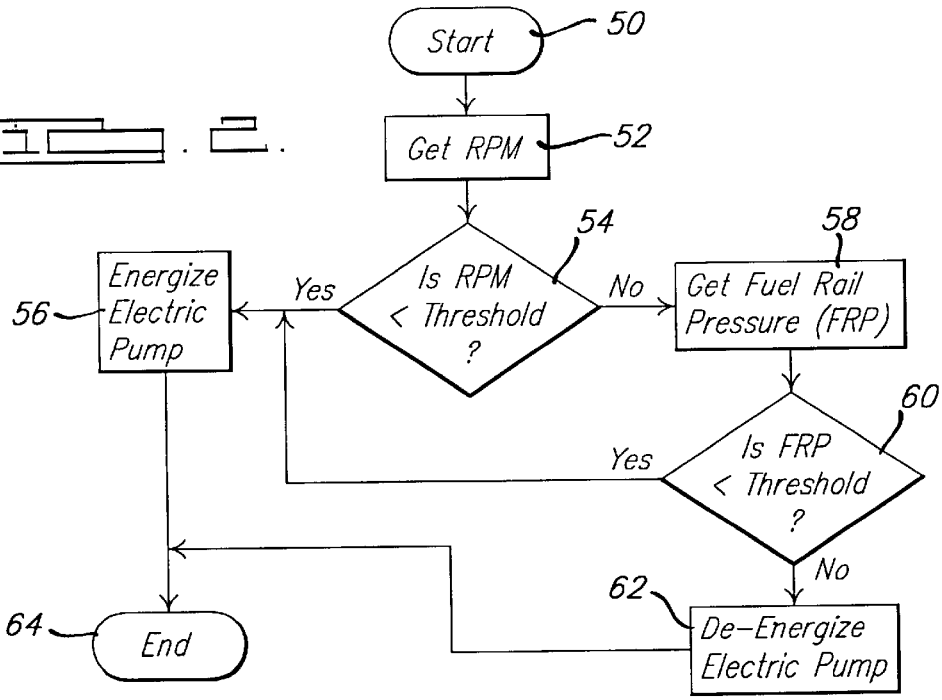
FIG. 2 is a flowchart illustrating a methodology of controlling the dual function fuel delivery system of the present invention.

Turning now to FIG. 2, a method for controlling the fuel delivery system of FIG. 1 is illustrated. The methodology starts in bubble 50, for example, at an ignition-on event, and falls through to block 52. In block 52, the methodology gets the RPM level of the engine in which the fuel delivery system of the present invention is installed. Preferably, this is accomplished by means of a sensor, although other conventional techniques may be employed. From block 52, the methodology continues to decision block 54.

In decision block 54, the methodology determines if the RPM retrieved at block 52 is greater than a first threshold value. The first threshold value is selected to correspond to an RPM level where a dry operating condition can occur. For example, the first threshold value may be set equal to the RPM level at idle in neutral (e.g. 700 RPM) although this amount may be calibrated according to the vehicle in which the system is installed.

If the RPM level is less than the first threshold value at decision block 54, the methodology continues from decision block 54 to block 56. However, if the RPM level is greater than or equal to the first threshold value at decision block 54, priming of the mechanical pump may be necessary. As such, the methodology continues from decision block 54 to block 58.

In block 58, the methodology gets the fuel rail pressure in a fuel rail of the fuel system in the vehicle in which the present invention is employed. Preferably, this is accomplished by a sensor although other conventional techniques may be employed. From block 58, the methodology advances to decision block 60.

In decision block 60, the methodology determines if the fuel rail pressure retrieved at block 58 is less than a second threshold level. The second threshold level is selected to correspond to a level where a dry operating condition can occur. For example, the second threshold value may be set equal to the pressure level at idle in neutral (e.g. 7000 psi) although this amount may be calibrated according to the vehicle in which the system is installed.

If the fuel rail pressure is less than the second threshold value at decision block 60, priming of the mechanical pump may be necessary. As such, the methodology continues to from decision block 60 to decision block 56. However, if the fuel rail pressure is greater than or equal to the second threshold value at decision block 60, priming is not necessary. Accordingly, the methodology continues from decision block 60 to block 62.

In block 56, the methodology energizes the electric pump 26 of FIG. 1 to supply fuel from the fuel tank 12 to the mechanical pump 16. In block 62, the methodology de-energizes the electric pump 26 of FIG. 1 to discontinue fuel delivery from the electric pump 26 to the mechanical pump 16. From blocks 56 and 62, the methodology advances to bubble 64 and exits the subroutine pending a subsequent execution thereof.

Thus, the dual function fuel delivery system of the present invention provides fuel by positive fuel pressure utilizing an electric pump and by direct vacuum utilizing a mechanical pump. With the ignition on, a controller monitors engine RPM and fuel rail pressure continuously. When either engine RPM or fuel rail pressure are less than a preselected value, power is supplied to the electric pump to provide positive fuel pressure to the mechanical gear-driven pump. Once both engine RPM and fuel rail pressure meet or exceed the preselected threshold value, a controller switches a relay to an off state thereby cutting power to the electric pump. With the power cut to the electric pump, the mechanical gear-driven pump-generated vacuum picks up fuel directly from the fuel tank. Advantageously, the fuel delivery system ensures that the mechanical pump is primed during potential dry operating conditions while only utilizing power for a small period of time thereby improving fuel economy and vehicle life. The fuel delivery system of the present invention also has the added benefit of being packagable into existing fuel supply systems within the fuel tank itself.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and following claims.

What is claimed is:

1. A fuel delivery system comprising:

a fuel tank;

an engine associated with said fuel tank;

a first pump coupled between said fuel tank and said engine for providing fuel from said fuel tank to said engine; and an electric pump coupled between said fuel tank and said first pump, said electric pump being adapted to selectively provide priming fuel from said fuel tank to said first pump, wherein said electric pump is disposed in said fuel tank.

2. The fuel delivery system of claim 1 wherein said first pump further comprises a mechanical gear driven pump.

3. The fuel delivery system of claim 1 further comprising a relay coupled to said electric pump for selectively providing power to said electric pump.

4. The fuel delivery system of claim 3 further comprising a power supply coupled to said electric pump by way of said relay such that selective operation of said electric pump is provided.

5. The fuel delivery system of claim 3 further comprising a controller coupled to said relay for selectively switching said relay between on and off states.

6. A fuel delivery system comprising:

a fuel tank;

an engine associated with said fuel tank;

a first pump coupled between said fuel tank and said engine for providing fuel from said fuel tank to said engine;

a second pump coupled between said fuel tank and said first pump, said second pump being adapted to selectively provide priming fuel from said fuel tank to said first pump; and a first check valve disposed between said fuel tank and said first pump for normally isolating said fuel tank from said first pump.

7. The fuel delivery system of claim 6 further comprising a second check valve disposed between said first pump and said second pump for normally isolating said second pump from said first pump.

8. The fuel delivery system of claim 7 wherein said first check valve has an opening pressure which is less than an opening pressure of said second check valve.

9. A method of controlling a fuel delivery system comprising:

providing an engine;

coupling a first pump to said engine;

providing a fuel tank;

disposing a first fuel line between said fuel tank and said first pump;

disposing a first check valve along said first fuel line between said fuel tank and said first pump for normally isolating said fuel tank from said first pump;

disposing a second fuel line between said fuel tank and said first pump;

coupling a second pump to said second fuel line;

detecting a potential dry operating condition of said first pump;

selectively operating said second pump to supply priming fuel to said first pump upon detection of said potential dry operating condition; and stopping said operating of said second pump upon a cessation of said potential dry operating condition.

10. The fuel delivery system of claim 9 wherein said second pump is disposed along said second fuel line between said fuel tank and said first pump.

11. The fuel delivery system of claim 9 wherein said potential dry operating condition further comprises one of a low rpm condition and a low fuel rail pressure condition.

12. The fuel delivery system of claim 9 further comprising disposing a second check valve along said second fuel line between said second pump and said first pump for normally isolating said second pump from said first pump.

13. The fuel delivery system of claim 12 wherein said first check valve has an opening pressure which is less than an opening pressure of said second check valve.

14. The fuel delivery system of claim 9 further comprising:

providing a power source;

coupling a relay between said power source and said electric pump; and connecting a controller to said relay and selectively switching said relay between on and off states to periodically provide power from said power source to said second pump.

15. A method of delivering fuel to an internal combustion engine comprising:

coupling a first pump to a fuel tank and to said engine;

coupling a second pump to said fuel tank and said first pump;

determining if an rpm level in said engine is less than a first threshold value;

determining if a fuel rail pressure in said engine is less than a second threshold value;

energizing said second pump to deliver fuel from said fuel tank to said first pump if said rpm level is less than said first threshold value or if said fuel rail pressure is less than said second threshold value; and de-energizing said second pump to stop fuel delivery to said first pump if said rpm level is greater than or equal to said first threshold value and said fuel rail pressure is greater than or equal to said second threshold value.

16. The method of claim 15 wherein said step of coupling said first pump to said fuel tank and to said engine further comprises coupling a mechanical gear driven pump to said fuel tank and said engine.

17. The method of claim 15 wherein said step of coupling said second pump to said fuel tank and said first pump further comprises coupling an electric pump to said fuel tank and said first pump.

18. The method of claim 17 wherein said step of coupling said electric pump to said fuel tank further comprises disposing said electric fuel pump along a fuel line between said fuel tank and said first pump.

19. The method of claim 17 wherein said step of coupling said electric pump to said fuel tank further comprises disposing said electric fuel pump in said fuel tank.

20. The method of claim 15 wherein said steps of energizing and de-energizing said second fuel pump further comprise switching a relay interposed between a power source and said second fuel pump between on and off states.

* * * * *